US007861470B2

(12) United States Patent
Lehane et al.

(10) Patent No.: US 7,861,470 B2
(45) **Date of Patent: *Jan. 4, 2011**

(54) SELF CENTERING SHAFT WALL SYSTEM

(75) Inventors: James Joseph Lehane, McHenry, IL (US); Francis Harold Laux, Wheeling, IL (US); Clifford Black, Chicago, IL (US)

(73) Assignee: United States Gypsum Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/772,411

(22) Filed: May 3, 2010

(65) Prior Publication Data

US 2010/0205873 A1 Aug. 19, 2010

Related U.S. Application Data

(63) Continuation of application No. 11/461,914, filed on Aug. 2, 2006, now Pat. No. 7,712,267.

(51) Int. Cl.
*E02D 19/00* (2006.01)

(52) U.S. Cl. ..... 52/169.5; 52/241; 52/302.1; 52/481.1

(58) Field of Classification Search ..... 52/169.5, 52/293.3, 274, 302.1, 302.3, 241, 242, 836, 52/842, 846, 481.1
See application file for complete search history.

(56) References Cited

U.S. PATENT DOCUMENTS

| | | | |
|---|---|---|---|
| 1,814,202 | A | 7/1931 | Winget |
| 1,981,239 | A | 11/1934 | Manske |
| 2,235,761 | A | 3/1941 | Goldsmith |
| 2,598,139 | A | 5/1952 | Verner |
| 2,857,588 | A | 10/1958 | Korol |
| 2,966,708 | A | 1/1961 | Freeman, Jr. |
| 3,017,672 | A | 1/1962 | Vaughan |
| 3,160,280 | A | 12/1964 | Burch |
| 3,423,893 | A | 1/1969 | Hyatt |
| 3,672,108 | A | 6/1972 | Conway |
| 3,811,238 | A | 5/1974 | Brinker |
| 3,844,085 | A | 10/1974 | Marchello |
| 3,908,328 | A | 9/1975 | Nelsson |
| 3,940,899 | A | 3/1976 | Balinski |
| 3,943,680 | A | 3/1976 | Balinski |
| 3,953,015 | A | 4/1976 | Taylor et al. |

(Continued)

OTHER PUBLICATIONS

Brochure, "Shaft Wall Systems", User's Guide, 2004, pp. 1-38, United States Gypsum Company, United States.

(Continued)

*Primary Examiner*—Brian E Glessner
*Assistant Examiner*—James J Buckle, Jr.
(74) *Attorney, Agent, or Firm*—Novak Druce + Quigg LLP; Pradip K. Sahu

(57) ABSTRACT

A J-runner, used in the construction of shaft walls in buildings is provided with a lifting element or ledge or both to permit simple centering of studs or shaft walls or both. By providing a lifting member in a lower J-runner, the studs or shaft walls or both can rest upon the lifting member to assist in vertically centering the studs or shaft walls or both when the shaft is fully constructed.

20 Claims, 4 Drawing Sheets

U.S. PATENT DOCUMENTS

| | | | |
|---|---|---|---|
| 3,956,998 | A | 5/1976 | Bavetz |
| 3,974,607 | A | 8/1976 | Balinski |
| 4,057,947 | A | 11/1977 | Oide |
| 4,106,251 | A | 8/1978 | Nelsson |
| 4,152,878 | A | 5/1979 | Balinski |
| 4,329,820 | A | 5/1982 | Wendt |
| 4,333,286 | A | 6/1982 | Weinar |
| 4,584,811 | A | 4/1986 | Balinski |
| 4,672,785 | A | 6/1987 | Salvo |
| 4,969,346 | A | 11/1990 | Bosl et al. |
| 5,092,100 | A | 3/1992 | Lambert et al. |
| 5,274,973 | A | 1/1994 | Liang |
| 5,501,547 | A | 3/1996 | Mantelli |
| 5,658,113 | A | 8/1997 | Lazo |
| 5,689,922 | A | 11/1997 | Daudet |
| 5,927,041 | A | 7/1999 | Sedimeier et al. |
| 5,930,963 | A | 8/1999 | Nichols |
| 6,131,361 | A | 10/2000 | Murphy |
| 6,161,824 | A | 12/2000 | Gustavson |
| 6,199,336 | B1 | 3/2001 | Poliquin |
| 6,364,303 | B1 | 4/2002 | Gustavson |
| 6,374,558 | B1 | 4/2002 | Surowiecki |
| 6,430,881 | B1 | 8/2002 | Daudet et al. |
| D467,007 | S | 12/2002 | Daudet et al. |
| 6,796,093 | B2 | 9/2004 | Brandes |
| 6,983,569 | B1 | 1/2006 | Rosenberg |
| 7,451,575 | B2 | 11/2008 | Hall et al. |
| 2003/0132641 | A1 | 7/2003 | Ponec et al. |
| 2004/0074200 | A1 | 4/2004 | Attalla |
| 2005/0138878 | A1 | 6/2005 | Becker et al. |
| 2006/0053722 | A1 | 3/2006 | Gwynn |

OTHER PUBLICATIONS

ICC Evaluation Service, Inc., "USG Drywall Shaft Partition Systems", Legacy Report No. NER-258, Reissued Apr. 1, 1991, pp. 1-5, ICC Evaluation Service, Inc., United States.

ICC Evaluation Service, Inc. "Dietrich Shaftwall and Stairwell Fire-resistive Assemblies", Legacy Report No. ER-5738, issued Nov. 1, 1995, pp. 1-4, ICC Evaluation Service, Inc., United States.

ICC Evaluation Service, Inc. "One-and Two-hour Fire-resistive Hardirock Gypsum Shaftwall Systems", Legacy Report No. ER-4924, Reissued Jan. 1, 2002, pp. 1-6, ICC Evaluation Service, Inc. United States.

ICC Evaluation Service, Inc., "Dietrich Shaftwall and Stairwell Fire Resistive Assemblies", Legacy Report No. NER-506, Reissued Apr. 1, 2004, pp. 1-5, ICC Evaluation Service, Inc., United States.

ICC Evaluation Service, Inc. "I-Stud Cavity Shaftwall System", Legacy Report No. 89-35.01, Reissued Apr. 1, 2005, pp. 1-13, ICC Evaluation Service, Inc., United States.

ICC Evaluation Service, Inc., "Fire Resistive Construction", Legacy Report No. 9525B, Reissued Dec. 1, 2005, pp. 1-3, ICC Evaluation Service, Inc., United States.

ICBO Evaluation Service, Inc., "Domtar 620 Series Shaftwall Systems", Evaluation Report No. 2541, Reissued Aug. 1, 1995, pp. 1-4, Evaluation Report, United States.

SELF CENTERING SHAFT WALL SYSTEM

CROSS REFERENCE TO RELATED APPLICATION

This application is a continuation of U.S. patent application Ser. No. 11/461,914 filed Aug. 2, 2006, now pending, incorporated herein by reference.

BACKGROUND

1. Field of the Invention

The invention relates generally to a J-runner for shaft wall construction apparatus used to hold wall panels in place during constructions of shaft walls in buildings.

2. Background of the Invention

Walls around shafts, such as elevator shafts, were traditionally formed from concrete. Such installations required personnel working inside the shaft to have to wait until the walls were completed, then remove debris and other material from the concrete erection.

As an improvement to the concrete systems, the assignee of the present invention developed a system whereby drywall (such as SHEETROCK brand gypsum board, available from United States Gypsum Corporation of Chicago, Ill.) or other wall panels can be installed from outside the shaft, thereby significantly reducing any scaffolding, and construction debris inside the shaft. By installing the wall panels from the outside, personnel working inside the shaft no longer needed to wait until the construction was completed to begin their work.

Such systems typically include a pair of J-runners into which a first wall panel is inserted, with the first J-runner along the top of the wall panel and a second J-runner along the bottom. The J-runner generally is formed from metals, such as steel, and typically includes a first short upstanding section and a second tall upstanding section in a substantially parallel configuration, each forming a substantially right angle with a middle section. Such a configuration allows for a first wall panel (or shaft panel) to be inserted between the upstanding sections to form the interior of the shaft. Additional wall panels can be affixed to the outside of the J-runners, typically to the outer surfaces of the short upstanding sections to form the interior of the room. In typical shaft wall constructions, wall studs, such as C-H studs and E-studs, are used to hold the wall panel in place. This type of construction is described by U.S. Pat. Nos. 3,943,680; 3,940,899; and 4,152,878, all to Balinski, each of which is hereby incorporated by reference in its entirety.

However, with this type of construction, vertically centering the wall studs is desired to achieve optimal structural performance. Additionally, when water or moisture develops in the cavity formed by the wall panels, the prior art constructions provide no means for dissipating such moisture.

SUMMARY OF THE INVENTION

To solve the deficiencies of conventional constructions, the J-runner of the invention is provided with one or more supporting or lifting elements which permit vertically centering/lifting the liner wall boards and the wall studs joined to the J-runner. In some instances the J-runner of the invention provides locations to dissipate moisture.

The J-runner of the invention is an improvement over conventional J-runners. One embodiment of the J-runner of the invention includes a short upstanding section and a tall upstanding section in a parallel configuration, each forming a substantially right angle with a middle section, with lifting elements positioned on the middle section and/or upstanding sections.

Typical embodiments of these lifting elements include shelves positioned on one or both upstanding sections, a longitudinal row of lanced and elevated forms having flattened ledges on upper sections on the middle section, and/or a longitudinal rib on the middle section.

In the figures, like numbered elements have the same configurations unless otherwise indicated.

DETAILED DESCRIPTION OF THE PREFERRED EMBODIMENTS

Figure 1:
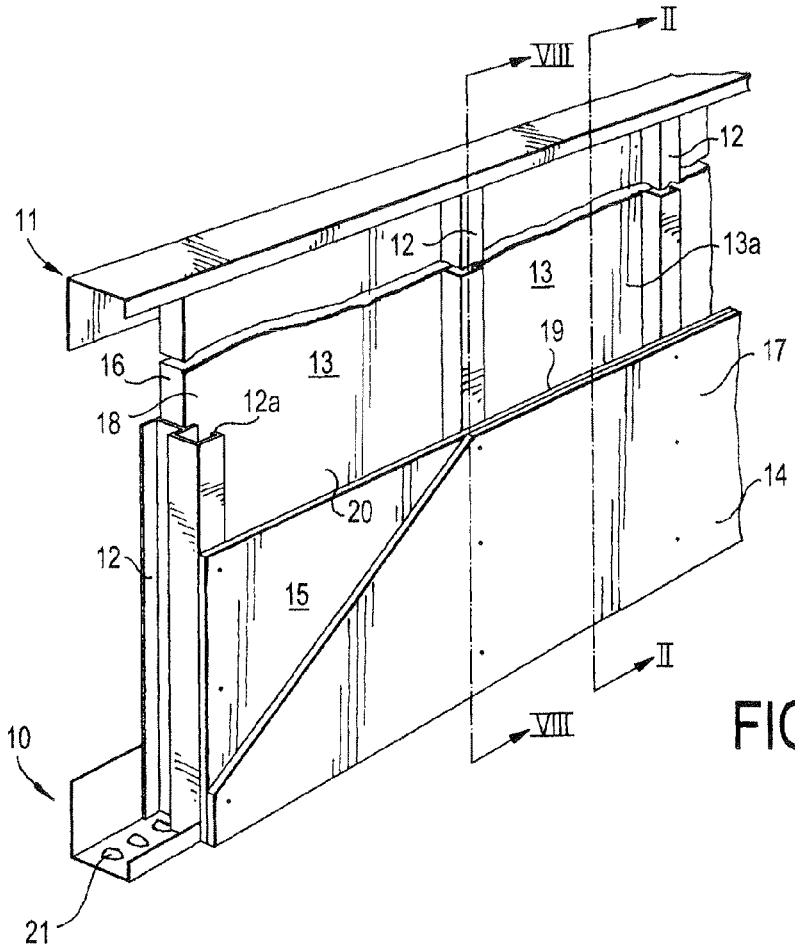
FIG. 1 is a cut-away view of a first embodiment of the J-runner of the invention in an installed condition.
Figure 2:
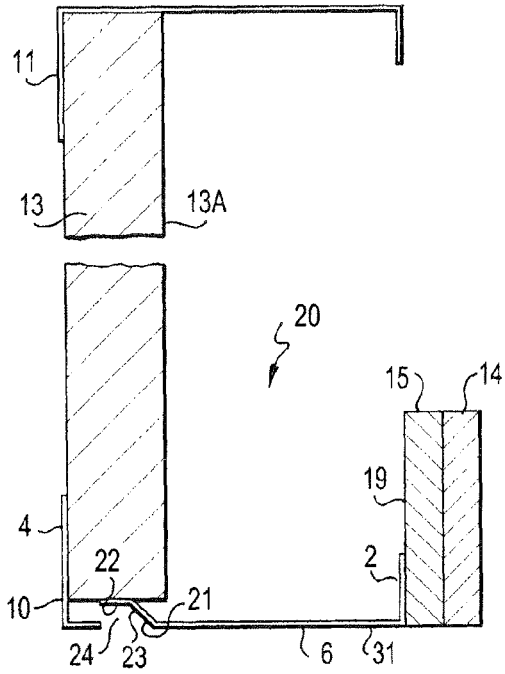
FIG. 2 is a cross-section of the assembly of FIG. 1, along line II-II.
Figure 3:
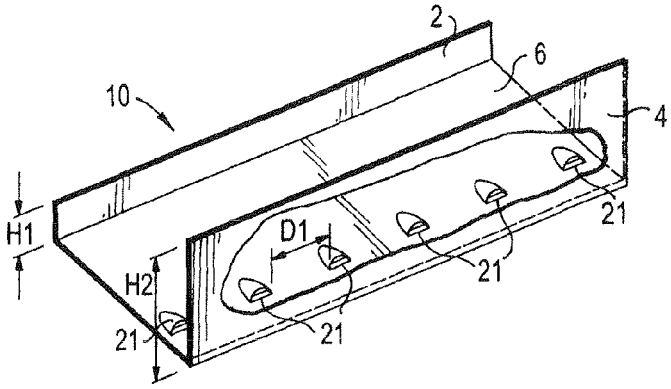
FIG. 3 shows a perspective view of the FIG. 1 second embodiment of a J-runner of the invention with a portion of a wall cut-away to show details of the embodiment.

With reference to FIGS. 1-3, typically, a first J-runner 10 and a second J-runner 11 are installed in a substantially parallel relationship, with multiple C-H studs 12 positioned in a substantially perpendicular relationship between the first J-runner 10 and the second J-runner 11. Each J-runner 10, 11 has a horizontal middle wall (section) 6, a shorter vertical wall 2, and a taller vertical wall 4 (FIG. 3). The middle wall 6 forms a substantially planar transverse plane having opposed first and second longitudinal sides each, having a length, and opposed first and second ends, each having a width, wherein the length of each longitudinal side is greater than the width of each end. The shorter vertical wall 2 has a first height H1 and the taller vertical wall 4 has a second height H2, wherein the first height H1 is less than the second height H2. The shorter vertical wall 2 extends to the first height from the first longitudinal side of the middle wall 6. The taller vertical wall 4 extends to the second height from the second longitudinal side of the middle section. The shorter vertical wall 2 and the taller vertical wall 4 are substantially parallel. The middle wall 6, the shorter vertical wall 2 and the taller vertical wall 4 form a generally J-shape.

Positioned between the first J-runner 10 and the second J-runner 11, and between each of the studs 12 is a single shaft panel 13. Each shaft panel 13 has opposed vertical edges 16 (one shown) inserted into a respective cavity of a stud 12. FIG. 1 shows one edge 16 inserted into a first stud, while the opposed other edge is hidden within a cavity of a second adjacent stud 12.

Located outside the J-runners 10 and 11 are a pair of wall boards 14 and 15. When fully installed as an inner surface of the shaft, shaft panel 13 forms the inside of the shaft, while an outer surface of the wall board 14 forms the interior wall of a room. Additionally, a surface 13A of the shaft panel 13 and a surface 19 of the wall board 15 define a wall cavity 20. The wall cavity 20 may be filled with insulation, electrical wiring, plumbing, and/or other building components.

To allow for self-centering of the panel 13 between the J-runners 10, 11, the first (or lower) J-runner 10 can be provided with one more lifting elements 21. FIG. 1 shows only J-runner 10 provided with lifting elements 21. The wall panel 13 lines up with lifting elements 21. If the wall stud 12 happens to also rest on a lifting element 21, then the wall stud 12 will also be centered. These lifting elements 21 are preferably constructed to allow for self-centering of the panels 13 and, possibly the studs 12, in a vertical direction during installation and when assembled. Self-centering means the studs and/or panels are spaced above the middle wall 6 of the first J-runner 10.

Preferably the lifting elements 21 form a flattened surface (ledge) 22 (FIG. 2) upon which the studs 12 and/or the shaft panel 13 can rest. The ledge 22 (FIG. 2) is typically formed with ramping edge 23. In typical embodiments, the ledges 22 have a height of from about 1/16 inch (0.16 mm) to about 1 inch (2.54 cm), preferably from about 1/8 inch (0.32 cm) to about 1/2 inch (1.3 cm), and more preferably about 1/4 inch (0.64 cm) to about 3/8 inch (0.95 cm). Also, lifting elements 21 are typically spaced apart a distance "D1" (FIG. 3) ranging from 1 to 6 inches (2.54 to 15.2 cm), preferably 2 to 6 inches (5.1 to 15.2 cm), for example 4 inches (10.2 cm) apart.

Figure 3A:
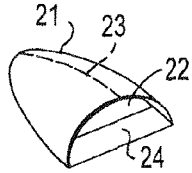
FIG. 3A is an enlarged view of a portion of FIG. 3.

Preferably, the lifting elements 21 provide an opening for a drain 24 (FIGS. 2, 3A) to allow for water or other moisture collected in the J-runner 10 to escape without damaging the shaft panel 13. The drain 24 can have the form of one large hole or space (FIG. 2), a plurality of smaller holes (e.g., perforated, not shown) or a channel to collect and direct moisture (not shown).

Generally, shaft panel 13 is inserted into the J-runner 10, pushed up the ramping edge 23 until it rests upon the ledge 22 and then slid horizontally until a first vertical edge of the shaft panel 13 is properly seated in a first stud 12. The formation of ledges 22 allows for more surface area against the shaft panel 13 and prevents the lifting element 21 from digging into the shaft panel 13 while sliding into the final position. Preferably, the shaft panel 13 is positioned resting on or above the ledges 22 and against the high wall of the J-runner 10. Then the next stud 12 is put into place between the lower J-runner 10 and upper J-runner 11 and pushed against the shaft panel 13 to have a second vertical edge of the shaft panel 13 seat in a cavity of the second stud 12.

Figure 4A:
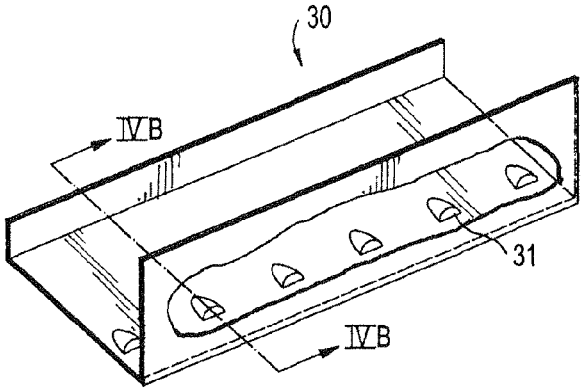
FIG. 4A shows a second embodiment of a J-runner of the invention with a portion of a wall cut-away to show details of the embodiment.
Figure 4B:
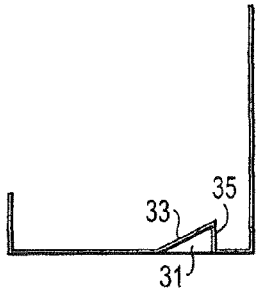
FIG. 4B is a cross-section of the embodiment of FIG. 4A along line IVB-IVB.

Although less preferred, it is additionally considered within the scope of the invention to form the lifting elements 21 without the ledges 22. FIGS. 4A and 4B show a second embodiment of a J-runner 30 of the invention having a lifting element 31, having a front ramping edge 33 and a substantially upstanding section 35, extending downward from the uppermost point of the ramping edge 33.

Figure 5A:
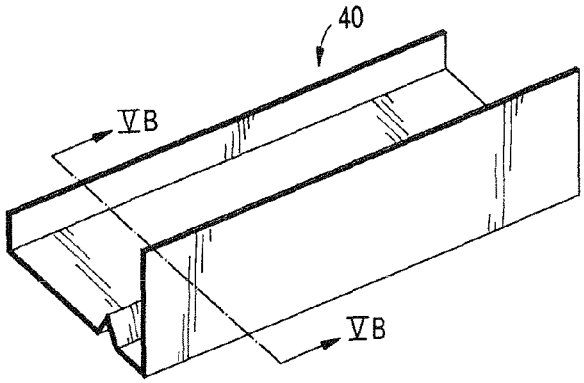
FIG. 5A shows a third embodiment of a J-runner of the invention.
Figure 5B:
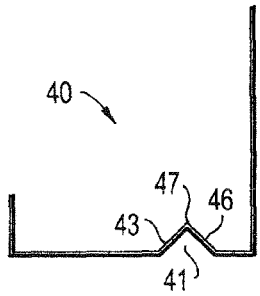
FIG. 5B is a cross-section of the embodiment of FIG. 5A along line VB-VB.

FIGS. 5A and 5B show a third embodiment, of a J-runner 40 of the invention having a lifting element 41 formed along the entire length of the J runner 40 at any location along the bottom of the J runner. The lifting element 41 has a front ramping edge 43 and a complementary rear ramping edge 46 which meet to form an elevated point or flat 47 to center wall studs 12, wall panels 13, or both.

Figure 6:
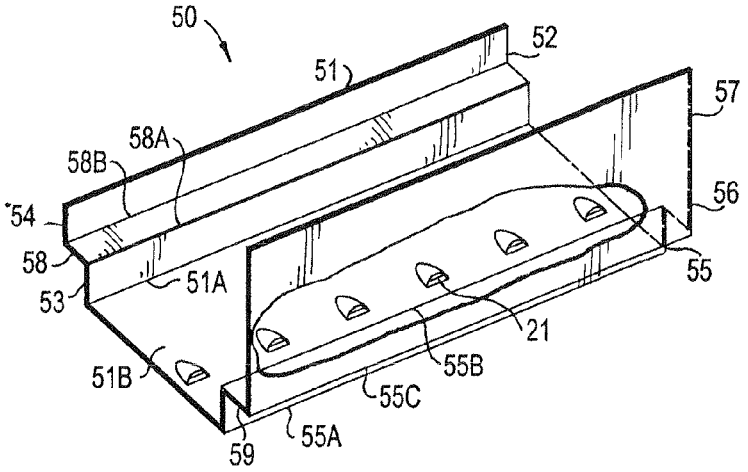
FIG. 6 is a perspective view of a fourth embodiment of the J-runner of the invention having two ridges (shelves) with a portion of a wall cut-away to show details of the embodiment.
Figure 7:
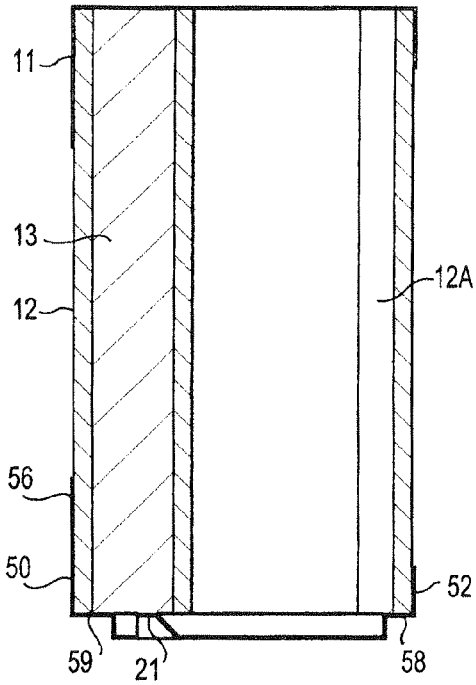
FIG. 7 is a cross-section of the embodiment of FIG. 1 along line VIII-VIII but modified to replace a lower J-runner with that of FIG. 6.

FIGS. 6-7 show a fourth embodiment, of a J-runner 50 of the invention which comprises a shelf 58, 59 (FIGS. 6-7) on one or both upright walls, in combination with, or as an alternative to, the lifting elements 21. Shelf 59 is designed to support the wall stud 12. If desired, shelf 59 may be designed to also support the panel 13. Shelf 58 is designed to support the wall stud 12 (FIG. 7). As seen in FIG. 7 (and FIG. 1), wall stud 12 has an in-turned lip 12A and the panel 13 is seated between walls of the stud 12 defining a cavity of the stud 12. Wall boards 14, 15 are omitted from FIG. 7 to make it easier to see other aspects of this embodiment.

FIG. 6 shows the first upstanding section 52 comprises a lower vertical portion 53, the transverse (horizontal) first upstanding section shelf 58, and an upper vertical portion 54. The upper vertical portion 54 having an upper edge 51. The first upstanding section lower portion 53 extends generally vertically from a first longitudinal side 51A of a middle section 51B. The first upstanding section shelf 58 extends distally, relative to the middle section 51B, from an upper longitudinal edge 58A of the lower portion 53 of the first upstanding section 52 to a lower longitudinal edge 58B of the upper portion 54 of the first upstanding section 52.

The second upstanding section 56 comprises a lower portion 55, the second upstanding section shelf 59, and an upper portion 57. The second upstanding section lower portion 55 extends generally vertically from the second longitudinal side 55A of the middle section 51B. The second upstanding section shelf 59 extends distally, relative to the middle section 51B, from an upper longitudinal edge 55B of the lower portion 55 of the second upstanding section 56 to a lower longitudinal edge 55C of the upper portion 57 of the second upstanding section 56.

The studs 12 can take the form of any stud suitable for placing in the present J-runner. Exemplary studs include C-T studs, tabbed I-studs, C-H studs and E studs, and can be formed of any suitable material. Typical materials for the studs include steel. For beginning or terminating a wall, typically a metal framing member having an E or J profile is used.

Similarly, the J-runners of the invention can be formed of any suitable material. Typical materials include steel, for example 24 gauge (0.024 in, 0.6 cm) or 20 gauge (0.035 in, 0.9 cm) or other suitable gauges. The J-runners and shelves can be formed by stamping or roll forming. To form the lifting elements, e.g. lifting element 21 of J-runner 10, the J-runner can be lanced, stamped, pierced or notched.

Figure 8:
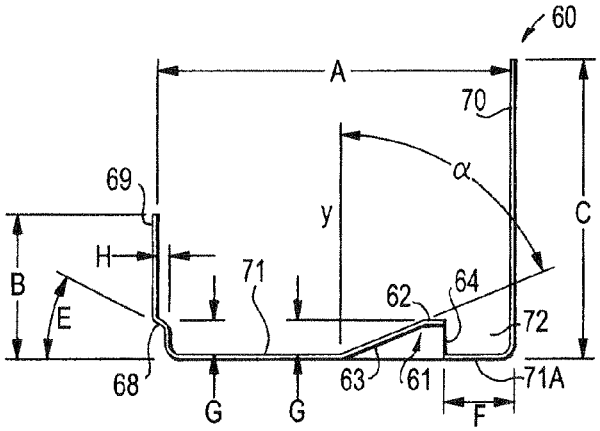
FIGS. 8-9 illustrate exemplary dimensions for a fifth embodiment of a J-runner of the invention.

FIG. 8 shows a fifth embodiment of a J-runner 60 of the present invention including a bottom (middle) section 71, a ledge 68 for its shorter wall 69, and lifting elements 61. With reference to FIG. 8, J-runner 60 typically has a total width "A" of from about 2 to 6 inches (5.1 to 15.2 cm), typically either 2.5 or 4.0 inches (6.4 or 10.2 cm), between its shorter upstanding wall 69 and its taller upstanding wall 70. The shorter upstanding wall 69 typically has a height "B" of from about 0.75 to 2.0 inches (1.9 to 5.1 cm), preferably approximately 1 inch (2.54 cm), while the taller upstanding wall 70 typically has a height "C" of from about 1.5 to 4 inches (3.8 to 10.2 cm), preferably about 2.0 to 2.5 inches (5.1 to 6.4 cm), more preferably about 2.1 inches (5.3 cm). (2.54 cm), while the taller upstanding wall 70 typically has a height "C" of from about 1.5 to 4 inches (3.8 to 10.2 cm), preferably about 2.0 to 2.5 inches (5.1 to 6.4 cm), more preferably about 2.1 inches (5.3 cm).

A portion 71A of the bottom (middle) section 71 adjacent to the taller upstanding wall 70, i.e., between a drain 64 and the taller upstanding wall 70, typically has a length "F" of from about 0.25 to 0.75 inches (0.6 to 1.9 cm), preferably about 0.50 inch (1.3 cm). Although length "F" is typically less than a thickness of shaft panel 13 (to permit the wall panel to be elevated by the lifting element 21), it is considered within the scope of the invention to increase F to a size greater than the width of the shaft panel 13, to permit the shaft panel 13 to rest in a pocket 72 defined by the ledge 62 and the taller upstanding wall 70.

A ramping edge 63 of the lifting element 61 can define an angle "a" of between 25° and 75°, preferably about 64° with respect to a y-axis parallel to the second upstanding section 70. While shown in FIG. 8 as being substantially transverse, shelf 68 can define other angles as well. For example, in the embodiment shown in FIG. 8, the shelf 69 defines an angle "E" of about 34°. It is also considered within the scope of the invention to form angle "E" relative to the bottom section 71 as any angle from 0 to less than 90° (at 90° there being no shelf). Typically angle "E" ranges from 0° to 60° , or 30° to 60° , such as 45 or 55° .

The ledge 62, in addition to the shelf 68, are typically independently spaced a height "G" of about 0.25 inch to 0.50 inch (0.6 to 1.3 cm), preferably about 0.25 inches (0.6 cm), from the bottom section 71. The inside edge of the shelf 68 can be spaced a distance "H" of between 0.05 inch and 1.0 inch (0.1 and 2.54 cm), typically about 0.06 inch to 0.09 inch (0.15 to 0.23 cm) from an upper portion of shorter wall 69.

Likewise, in the embodiment of FIG. 7 (although not labeled), the two shelves 58, 59 and lifting element 21 would typically have height "G" of about 0.25 inch to 0.50 inch (0.6 to 1.3 cm), preferably about 0.25 inches (0.6 cm), from the bottom section as described for shelf 68 and ledge 62 of FIG. 8. Also, the inside edge of the shelves 58, 59 would be spaced from an upper portion of shorter wall 52 by a distance "H" of between 0.05 inch and 1.0 inch (0.1 and 2.54 cm), typically about 0.06 inch to 0.09 inch (0.15 to 0.23 cm), as described for shelf 68 of FIG. 8.

Figure 9:
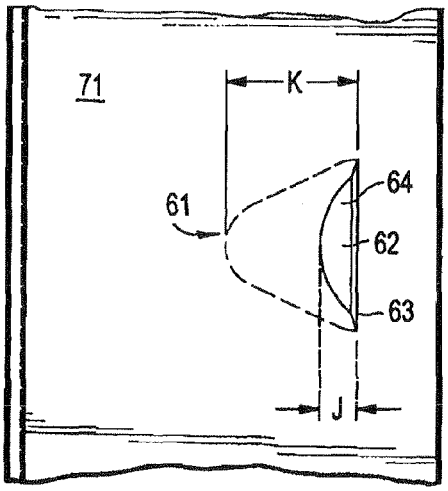

With reference to FIG. 9, the drain 64 of the lifting element 61 can have a generally triangular shape, optionally with rounded corners. However, it is considered within the scope of the invention to form the drain 64 of any polygonal shape, such as rectangular, octagonal, or any section of a circular, oval or elliptical shape. Preferably, the drain 64 can be semi-circular. The shape of the ledge 62 can additionally substantially correspond to the shape of the drain 64—although of a shorter length J. However, in preferred embodiments, the shape of the ledge 62 is defined by a chord of a circle, such as semicircular (where the chord passes through the center of the circle. Length J of ledge 62 is typically between 1/16 inch and 1/4 inch (0.16 and 0.63 cm), preferably approximately 1/8 inch (0.3 cm), from its connection to the bottom section 71.

The drain 64 can have a total length K of about 0.25 inch to 1.00 inch (0.63 to 2.54 cm), typically 0.50 inch to 0.90 inch (1.3 to 2.3), preferably about 0.78 inch (2 cm) when in a triangular shape, and typically about 0.25 inch to 0.50 inch (0.63 to 1.3 cm), preferably about 0.45 inch (1.1 cm) when in a semicircular shape.

Figure 10:
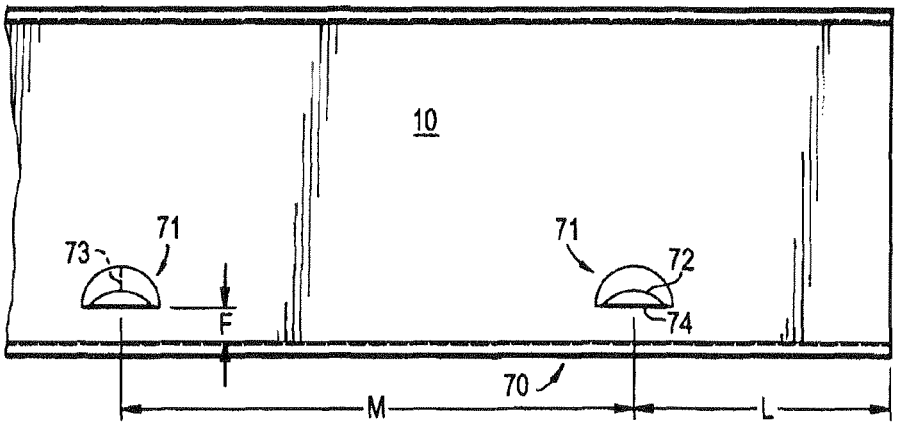
FIG. 10 illustrates a portion of a sixth embodiment of a J-runner of the invention.

FIG. 10 shows a sixth embodiment 70 of the present invention which is the same as the first embodiment, J-runner 10, but the lifting elements 71 are semi-circular with ledges 72. Lifting elements 71 have a ramping edge 73 and form a drain 74. With reference to FIG. 10, the lifting elements 71 are typically spaced a distance L of about 2 inches to 8 inches (5.1 to 20.3) from the extreme end of the J-runner and a distance M of about 2 inches to 8 inches (5.1 to 20.3) between each other. Preferably, M is greater than or equal to L. For example, in preferred embodiments, L is about 4 inch to 6 inches (10.2 to 15.2 cm) or less while M is approximately 4 inches to 6 inches (10.2 to 15.2 cm), respectively.

Figure 11:
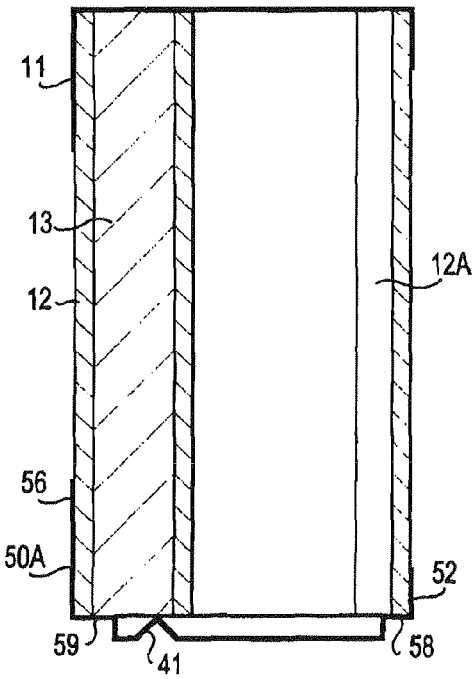
FIG. 11 is a cross-section of the embodiment of FIG. 1 along line VIII-VIII but modified to replace a lower J-runner with that of FIG. 7, further modified to include a lifting element of FIG. 5A.

FIG. 11 is a cross-section of the embodiment of FIG. 1 along line VIII-VIII but modified to replace a lower J-runner with that of FIG. 7 further modified to include lifting element 41 of FIG. 5A. FIG. 11 shows a stud 12 resting on shelves 58, 59 of the lower L-runner 50A upright walls and the shaft panel 13 resting in an at rest position on the shelf 59 of one of the lower L-runner upright walls and lifting element 41.

Although FIG. 1 shows an installation with a first (lower) J-runner 10 of the invention, i.e., with lifting elements 21, and the second (upper) J-runner 11 without any lifting elements, it is considered within the scope of the invention to utilize two same J-runners of the invention, e.g., two J-runners 10, i.e., one above the shaft panel 13 and one below the shaft panel 13. Likewise, it is considered within the scope of the invention to utilize a first J-runner of one embodiment of the invention in combination with a J-runner of another embodiment of the invention.

It should be apparent that embodiments other than those specifically described above may come within the spirit and scope of the present invention. Hence, the present invention is not limited by the above description.

We claim:

1. A J-runner for shaft wall construction comprising:

a substantially planar transverse middle section having opposed first and second longitudinal sides each having a length and opposed first and second ends each having a width, wherein the length of each longitudinal side is greater than the width of each end;

a first upstanding section and a second upstanding section extending upwardly from the transverse middle section, wherein the first upstanding section has a first height and the second upstanding section has a second height, wherein the first height is less than the second height, the first upstanding section extending to the first height from the first longitudinal side of the middle section, and the second upstanding section extending to the second height from the second longitudinal side of the middle section, wherein the first upstanding section and the second upstanding section are substantially parallel, and wherein the middle section, the first upstanding section and the second upstanding section form a generally J-shape;

at least one lifting element disposed on the middle section;

wherein the at least one lifting element disposed on the middle section comprises a first ramping edge extending upwardly from the transverse middle section, the first ramping edge having a first end connected to the middle section, and having a second end disposed from the middle section to be between the first upstanding section and the second upstanding section, wherein the first ramping edge of the lifting element is disposed at an angle $\alpha$, and $\alpha$ is greater than 45° and less than 90° with respect to a y-axis parallel to the second upstanding section and passing through the first end of the respective lifting element, the first end of the at least one lifting element being proximal to the first upstanding section and the second end of the at least one lifting element being distal to the first upstanding section, further comprising at least one lifting member, selected from the group consisting of a first upstanding section shelf aligned substantially parallel to the middle section and a second upstanding section shelf, aligned substantially parallel to the middle section;

wherein if the J-runner comprises the first upstanding section shelf, then the first upstanding section comprises a first lower portion, the first upstanding section shelf, and an first upper portion, the first upstanding section lower portion extending generally vertically from the first longitudinal side of the middle section, and the first upstanding section shelf transversely extends distally, relative to the middle section, from an upper longitudinal edge of the first lower portion of the first upstanding section to a lower longitudinal edge of the first upper portion of the first upstanding section; and wherein if the J-runner comprises the second upstanding section shelf, then the second upstanding section comprises a second lower portion, the second upstanding section shelf, and a second upper portion, the second upstanding section lower portion extending generally vertically from the second longitudinal side of the middle section, and the second upstanding section shelf transversely extends distally, relative to the middle section, from an upper longitudinal edge of the second lower portion of the second upstanding section to a lower longitudinal edge of the upper portion of the second upstanding section.

2. The J-runner of claim 1, wherein angle $\alpha$ is in a range of 55° to 64 °.

3. The J-runner of claim 1, wherein the lifting element comprises a ledge and the first ramping edge is connected to the middle section at the first end, and to the ledge at the second end.

4. The J-runner of claim 1, wherein the lifting element defines a drain in the middle section, positioned at least partially below the first ramping edge.

5. The J-runner of claim 1, comprising a plurality of the lifting elements, positioned along the middle section.

6. The J-runner of claim 1, wherein the at least one lifting element comprises a second ramping edge, connected at a first end to the middle section, and at an opposite second end connected to the second end of the first ramping edge.

7. The J-runner of claim 1, wherein the at least one lifting member comprises the first upstanding section shelf and the second upstanding section shelf.

8. A shaft wall assembly having upper, lower, left and right sides, the assembly comprising;

a horizontal first J-runner, in accordance with claim 1, positioned at the lower side of the shaft wall assembly;

a horizontal second J-runner, positioned at the upper side of the shaft wall assembly;

a vertical first stud of the shaft wall between the first J-runner and the second J-runner;

a vertical second stud between the first J-runner and the second J-runner;

a panel having opposed first and second edges, the first edge seated in a cavity in the first stud and the second edge seated in a cavity in the second stud.

9. The assembly of claim 8, wherein the at least one lifting member comprises the first upstanding section shelf and the second upstanding section shelf.

10. The assembly of claim 8, wherein the at least one lifting element comprises a ledge and the first ramping edge is connected to the middle section at the first end, and to the ledge at the second end, wherein the ledge is substantially parallel to the middle section, wherein the lifting element defines a drain in the middle section below the ledge, comprising a plurality of the lifting elements, positioned along the middle section, wherein the plurality of lifting elements are positioned along the middle section.

11. The assembly of claim 8, wherein the lifting element comprises a ledge and the first ramping edge is connected to the middle section at the first end, and to the ledge at the second end.

12. The assembly of claim 11, wherein the shaft wall is positioned on the ledge.

13. A J-runner for shaft wall construction comprising:

a substantially planar transverse middle section having opposed first and second longitudinal sides each having a length and opposed first and second ends each having a width, wherein the length of each longitudinal side is greater than the width of each end;

a first upstanding section and a second upstanding section extending upwardly from the transverse middle section, wherein the first upstanding section has a first height and the second upstanding section has a second height, wherein the first height is less than the second height, the first upstanding section extending to the first height from the first longitudinal side of the middle section, and the second upstanding section extending to the second height from the second longitudinal side of the middle section, wherein the first upstanding section and the second upstanding section are substantially parallel, and wherein the middle section, the first upstanding section and the second upstanding section form a generally J-shape;

at least one lifting element disposed on the middle section;

wherein the at least one lifting element disposed on the middle section comprises a first ramping edge extending upwardly from the transverse middle section, the first ramping edge having a first end connected to the middle section, and having a second end disposed from the middle section to be between the first upstanding section and the second upstanding section, wherein the first ramping edge of the lifting element is disposed at an angle $\alpha$, and $\alpha$ is greater than 45° and less than 90° with respect to a y-axis parallel to the second upstanding section and passing through the first end of the respective lifting element, the first end of the at least one lifting element being proximal to the first upstanding section and the second end of the at least one lifting element being distal to the first upstanding section, wherein the lifting element comprises a ledge and the first ramping edge is connected to the middle section at the first end, and to the ledge at the second end, wherein the ledge is substantially parallel to the middle section, wherein the lifting element defines a drain in the middle section below the ledge, comprising a plurality of the lifting elements, positioned along the middle section, wherein the plurality of lifting elements are positioned along the middle section.

14. The assembly of claim 8, wherein the at least one lifting element defines a drain in the middle section below the ramping edge.

15. The assembly of claim 8, wherein the second J-runner is a J-runner according to claim 1.

16. The J runner of claim 13, further comprising at least one lifting member, selected from the group consisting of a first upstanding section shelf and a second upstanding section shelf, aligned substantially parallel to the middle section;

wherein if the J-runner comprises the first upstanding section shelf, then the first upstanding section comprises a first lower portion, the first upstanding section shelf, and an first upper portion, the first upstanding section lower portion extending generally vertically from the first longitudinal side of the middle section, and the first upstanding section shelf transversely extends distally, relative to the middle section, from an upper longitudinal edge of the first lower portion of the first upstanding section to a lower longitudinal edge of the first upper portion of the first upstanding section; and wherein if the J-runner comprises the second upstanding section shelf, then the second upstanding section comprises a second lower portion, the second upstanding section shelf, and a second upper portion, the second upstanding section lower portion extending generally vertically from the second longitudinal side of the middle section, and the second upstanding section shelf transversely extends distally, relative to the middle section, from an upper longitudinal edge of the second lower portion of the second upstanding section to a lower longitudinal edge of the upper portion of the second upstanding section.

17. The assembly of claim 8, wherein at least one of the first stud and the second stud is positioned on the first upstanding section shelf.

18. The assembly of claim 8, wherein at least one of the first stud and the second stud is positioned on the at least one of the first upstanding section shelf and the second upstanding section shelf.

19. A J-runner comprising:

a substantially planar transverse middle section having opposed first and second longitudinal sides each having a length and opposed first and second ends each having a width, wherein the length of each longitudinal side is greater than the width of each end;

a first upstanding section and a second upstanding section extending upwardly from the transverse middle section, wherein the first upstanding section has a first height and the second upstanding section has a second height, wherein the first height is less than the second height, the first upstanding section extending to the first height from the first longitudinal side of the middle section, and the second upstanding section extending to the second height from the second longitudinal side of the middle section, wherein the first upstanding section and the second upstanding section are substantially parallel, and wherein the middle section, the first upstanding section and the second upstanding section form a generally J-shape; and lifting members comprising a second upstanding section shelf aligned substantially parallel to the middle section, and at least one lifting element disposed on the middle section;

wherein the second upstanding section comprises a lower portion, the second upstanding section shelf, and an upper portion, the second upstanding section lower portion extending generally vertically from the second longitudinal side of the middle section, and the second upstanding section shelf transversely extends distally, relative to the middle section, from an upper longitudinal edge of the first lower portion of the second upstanding section to a lower longitudinal edge of the upper portion of the second upstanding section; and wherein the at least one lifting element disposed on the middle section comprises a first ramping edge extending upwardly from the transverse middle section, the first ramping edge having a first end connected to the middle section, and having a second end disposed from the middle section to be between the first upstanding section and the second upstanding section.

20. A shaft wall assembly having upper, lower, left and right sides, the assembly comprising;

a horizontal first J-runner, in accordance with claim 13, positioned at the lower side of the shaft wall assembly;

a horizontal second J-runner, positioned at the upper side of the shaft wall assembly;

a vertical first stud of the shaft wall between the first J-runner and the second J-runner;

a vertical second stud between the first J-runner and the second J-runner;

a panel having opposed first and second edges, the first edge seated in a cavity in the first stud and the second edge seated in a cavity in the second stud.

* * * * *